United States Patent [19]

Jarosh et al.

[11] 4,151,937

[45] May 1, 1979

[54] HOLDING DEVICE FOR GOLF ITEMS

[76] Inventors: Frank J. Jarosh, 957 21st St., Upland, Calif. 91786; George W. Haines, 7378 Ruby La., Cucamonga, Calif. 91730; Gilbert T. Johnson, 21816 Klickitat, Apple Valley, Calif. 92703

[21] Appl. No.: 850,276

[22] Filed: Nov. 10, 1977

[51] Int. Cl.[2] ..... A45F 5/00

[52] U.S. Cl. ..... 224/252; 206/315 R; 224/247; 273/32 A; 273/32 B; 224/918

[58] Field of Search ..... 224/5 R, 5 A, 5 C, 5 D, 224/26 R, 26 B, 28 D, 29 B; 273/32 A, 32 B, 32 D, 162 R, 162 A, 162 C, 162 D, 162 F; 206/38, 315 R, 579

[56] References Cited

U.S. PATENT DOCUMENTS

| | | | |
|---|---|---|---|
| 1,627,145 | 5/1927 | Breed | 224/5 C |
| 1,957,377 | 5/1934 | Whittle | 224/5 C X |
| 1,973,819 | 9/1934 | Link | 224/5 C X |
| 2,211,635 | 8/1940 | Barteaux | 273/162 A X |
| 2,364,007 | 11/1944 | Stanton | 206/315 R X |
| 3,360,807 | 1/1968 | Mauck | 273/162 F X |
| 3,744,801 | 7/1973 | Morritt | 273/32 A X |
| 3,753,519 | 8/1973 | Gammon | 224/5 C |
| 3,799,331 | 3/1974 | White | 206/315 R |
| 3,830,415 | 8/1974 | Jacobson et al. | 224/5 C |

*Primary Examiner*—Charles E. Frankfort
*Assistant Examiner*—Winston H. Douglas
*Attorney, Agent, or Firm*—John T. Matlago

[57] ABSTRACT

A holding device is provided having openings thereon in which small golfing items can be conveniently carried for use by a golfer while playing a game of golf.

5 Claims, 18 Drawing Figures

3
4
60
10
11b
62
7
71
15
63
70
25
27
72
29
11a
26
13

60
71
15
11b
62
20
40
21
11a
63

18
19
11b
5
15
60
62
30b
20
43
45
13
32b
21
44
63
36
42
40
33b
48

60
15
6
23
11a
70
27
62
29
30a
37
52
20
50
56
32a
63
21
33a
54
22

70

27
71
72
29
52
50
22
11a 19
11b
30b
18
32b
20
48
33b
21

23
11a
37
30a
22
20
32a
54
21
33a 70
8
71

72
45
10
8
52
43
50
44
56
11b
11a
36
19
23

HOLDING DEVICE FOR GOLF ITEMS

This invention relates to aids for the game of golf and more particularly to a holding device especially adapted for carrying and making readily available small items used by a golfer.

During the course of playing the game of golf, a golfer needs to keep certain small items handy such as a pencil, golf tees and a ball marker. Usually the golfer carries such items by intermingling them along with other small articles in his pockets. However, because these golf items are so small, it is somewhat annoying for the golfer to have to locate and segregate a particular one from the others in his pockets each time it is needed.

Accordingly, one of the objects of the present invention is to provide a small holding device which can be conveniently clipped on a belt or pocket of a golfer and in which golfing items can be mounted so that they can be readily removed and returned back thereto after they have been used.

Another object of the present invention is to provide an inexpensive holding device for carrying small items needed during the game of golf.

Yet, another object of the present invention is to provide a holding device having a structure which provides for positively holding small items needed for the game of golf and at the same time makes it easy for these items to be easily removed from and returned back into the holding device as desired.

With these and other objects in view, the invention consists of the construction, arrangement and combination of the various parts of the device whereby the objects contemplated are attained, as hereinafter set forth, pointed out in the appended claims and illustrated in the accompanying drawings.

Figure 1:
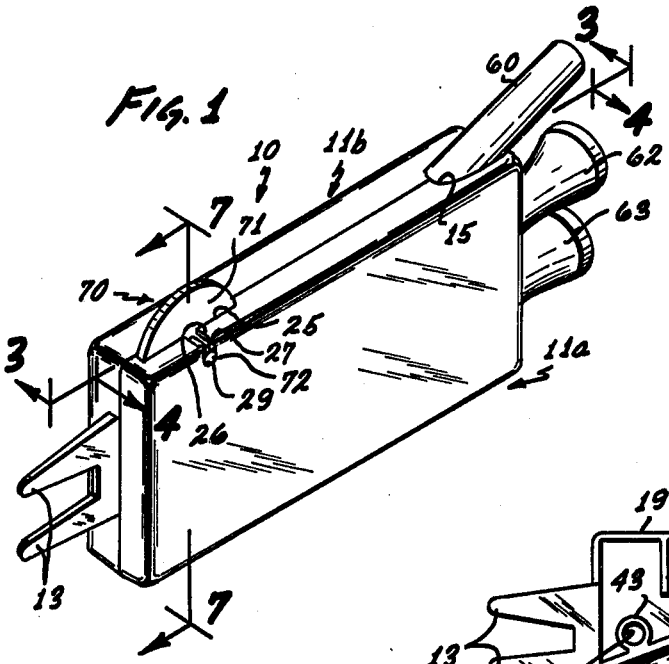
FIG. 1 is a perspective view of a holding device embodying the features of the present invention.
Figure 2:
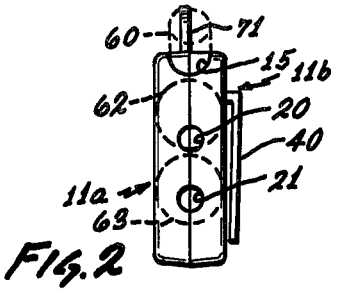
FIG. 2 is an end view of the device shown in FIG. 1.

Referring to FIG. 1 of the drawings, the holding device 10 of the present invention comprises a small rectangularly shaped plastic box or case which is a little more than twice as long as it is high and whose depth or thickness is approximately one-third its height. The thickness of device 10 is divided longitudinally to provide a molded mating front portion **11*a* and back portion 11*b*. Back portion 11*b* is formed with a pair of prongs 13 extending from one end thereof. On the upper corner wall of device 10 opposite the pronged end thereof is a circular opening 15 having an axis which is oriented such that it extends angularly downwardly, i.e. diagonally, through the interior of the device toward the pronged end thereof. In addition to opening 15, this end of the device 10, as shown in FIG. 2, is provided with a pair of spaced circular openings 20 and 21, the axis of each of which is oriented to extend angularly downwardly into the interior of the device. Located on the top of the front portion 11*a* of the device adjacent the pronged end thereof is a short longitudinal slot 25 having a transverse slot 26 centrally thereof. The slot 26 forms a neck 27 on the upper edge of the front wall 22 of the device which leads down to a slightly enlarged circular opening 29**.

Figure 3:
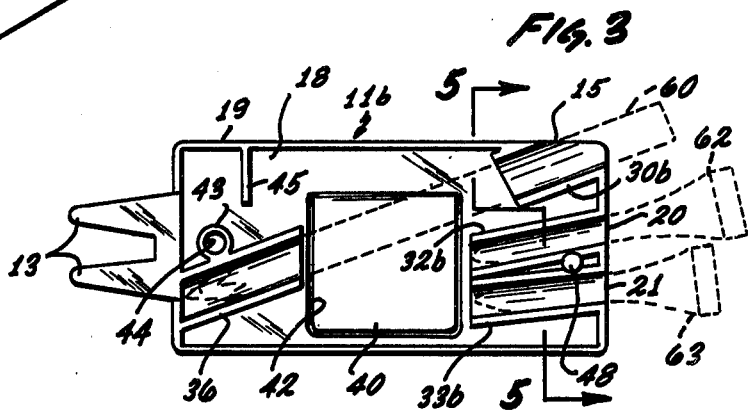
FIG. 3 is a view taken along lines 3—3 in FIG. 1 showing the interior of the back portion of the device.

As shown in FIG. 3, the interior of the back portion **11*b* comprises an upright back wall 18 provided with a peripheral rim 19. The back wall 18 has a square opening 42 formed therein which is covered by a laterally offset clip 40 having its upper edge integrally joined with the upper edge of opening 42. The interior upper end corner of the rear portion 11*b* of the holder 10 is molded to form a short length of a semicircularly shaped entrance wall 30*b* which is aligned with the back half of opening 15 on the rim 19. Further, the interior of this end of the rear portion 11*b* is molded to form short lengths of semicircularly shaped walls 32*b* and 33*b* which are aligned with the back halves of openings 20 and 21, respectively. The interior of the pronged end of the rear portion 11*b* is molded to form a short length of semicircularly shaped wall 36 which is aligned with the entrance wall 30*b*. Spaced inwardly from the pronged end of the rear portion 11*b*, a vertical rib 45 extends down from the top rim thereof. On the interior of the rear portion 11*b*, a cylindrically shaped projection 43 with a circular opening 44 is provided adjacent the end with prongs 13 and a pin 48 is provided adjacent the other end thereof. The pin 48 projects outwardly beyond the rim 19 of the rear portion 11*b***.

Figure 4:
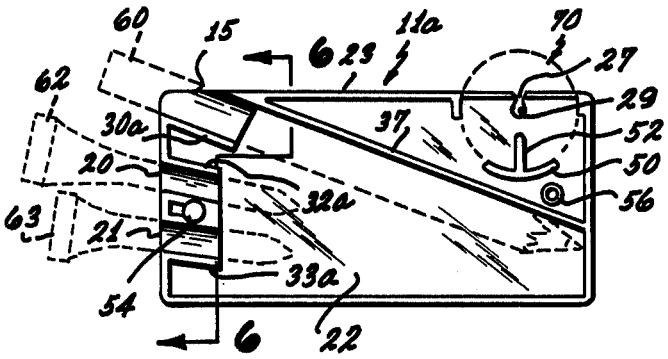
FIG. 4 is a view taken along line 4—4 in FIG. 1 showing the interior of the front portion of the device.
Figure 8:
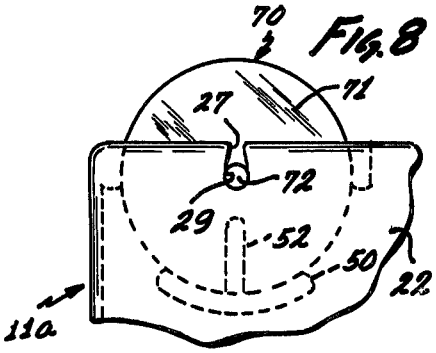
FIG. 8 is an enlarged view of a portion of the upper corner of the device taken along line 7—7 in FIG. 6.
Figure 5:
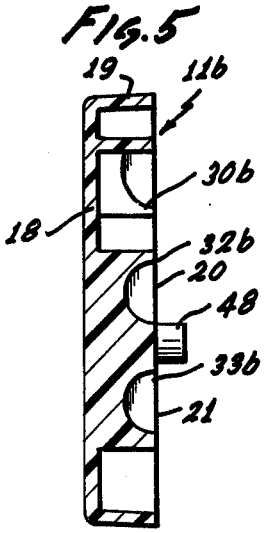
FIG. 5 is a sectional view taken along line 5—5 in FIG. 3.
Figure 6:
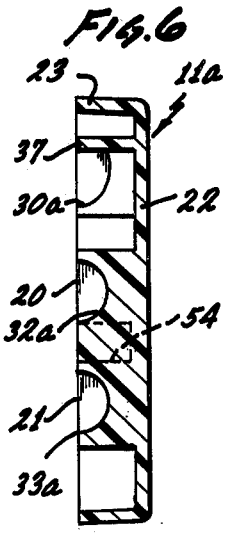
FIG. 6 is a sectional view taken along line 6—6 in FIG. 4.
Figure 7:
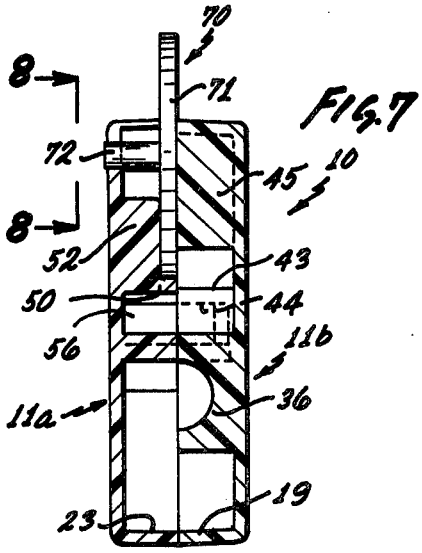
FIG. 7 is a sectional view taken along line 7—7 in FIG. 1.

As shown in FIG. 4, the interior of the front portion **11*a* of device 10 is comprised of the upright front wall 22 provided with a peripheral rim 23. The upper end of the device 10 is molded to form a short length of a semicircularly shaped entrance wall 30*a* which is aligned with the front half of the opening 15 in rim 23. It should be noted that the upper side of the wall 30*a* continues on angularly downwardly toward the opposite end of the device to form a guide wall 37. Further, the interior of this end of the front portion 11*a* is molded to form short lengths of semicircularly shaped walls 32*a* and 33*a* which are aligned with the front halves of openings 20 and 21, respectively. An arcuate wall 50 whose center is the circular bottom 29 of the slot 27 is formed within the front portion 11*a*. Extending upwardly from the arcuate wall 50 is a radial rib 52 which has a depth less than the arcuate wall 50**.

Also, on the interior of the front portion 11*a*, a circular opening 54 is provided adjacent the end of the portion 11*a* provided with the openings 20 and 21, and a pin 56 is located adjacent the opposite end. The pin 56, similarly to pin 48 on the back portion 11*b*, projects outwardly beyond the rim 23 of the front portion 11*a*. Thus, when the front portion 11*a* and the back portion 11*b* are mated, and pressed together, the circular opening 54 on front portion 11*a* tightly receives pin 48 on the rear portion 11*b* and the circular opening 44 on the rear portion 11*b* tightly receives pin 56 on the front portion 11*a*.

After the front and back portions 11*a* and 11*b* of the device 10 are assembled together, the sharpened end of a short pencil 60, as normally provided for golfers, is inserted into the angularly disposed opening 15 provided on the upper corner thereof. The pencil is slidingly directed along the passageway formed within the device by the entrance walls 30*a* and 30*b* and is guided by guide wall 37 to engage the aligned wall 36 on the other end thereof with a frictional fit. When fully inserted in the opening 15, a small end portion of the pencil 60 is exposed. Likewise, the bodies of golf tees 62 and 63 are inserted in the respective openings 20 and 21 provided on the end of the device so as to engage the passage ways formed by the internal walls 32*a*–32*b* and 33*a*–33*b*, respectively, with a frictional fit. When so inserted, approximately half of the length of each tee is exposed. It should be noted that the bodies of tees are naturally formed with a taper which helps to positively hold them in their openings. Although the pencil has no taper on its body, in addition to the fact that it is held in a more tilted position than the tees, its body is contacted over a sufficiently larger area such that friction tends to hold it positively in place.

A ball marker 70 comprising a flat circular body 71 and a stem 72 has its body 71 inserted in the longitudinal slot 25 provided on the top of the device with the bottom edge of the body 71 resting on the arcuate wall 50, and with the end of the stem 72, upon being snapped down past neck 27 of the transverse slot 26, resting in the circular bottom 29. When so disposed, the body 71 is held between the ribs 45 and 52 provided on the rear portion 11*b* and the front portion 11*a*, respectively. It should be noted that the body 71 of the ball marker 70 extends beyond the upper edge of the device 10 for easy gripping by the fingers for removal.

Figure 9:
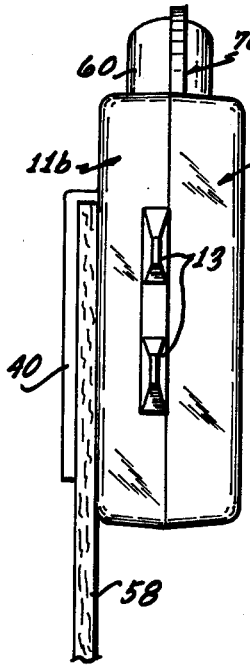
FIG. 9 is an end view of the device showing it mounted on a belt of a golfer.
Figure 12:
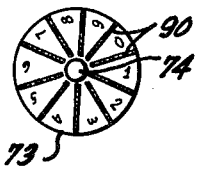
FIG. 12 is a view of a digit wheel.

The clip 40 integrally formed on the back wall 18 enables the device 10 to be mounted on a belt 58 of a golfer (FIG. 9). Thus, the device 10 is held in a convenient position to enable the golfer to remove the golfing items from the respective openings thereon when desired and to insert them back into these respective openings after use.

It should be especially noted that the mating semicircularly shaped walls on the interior of the respective front and back portions of the holding device 10 for receiving the bodies of the pencil 60 and tees 62 and 63 need not be of equal length since all that is required is that these items be directed inwardly in the proper direction and that the contact area be large enough to provide friction for a positive hold. Furthermore, inasmuch as both the pencil and tees are directed angularly downwardly into the interior of the device, they tend to settle and to be positively held in their openings in the device with a minimum of friction.

Figure 10:
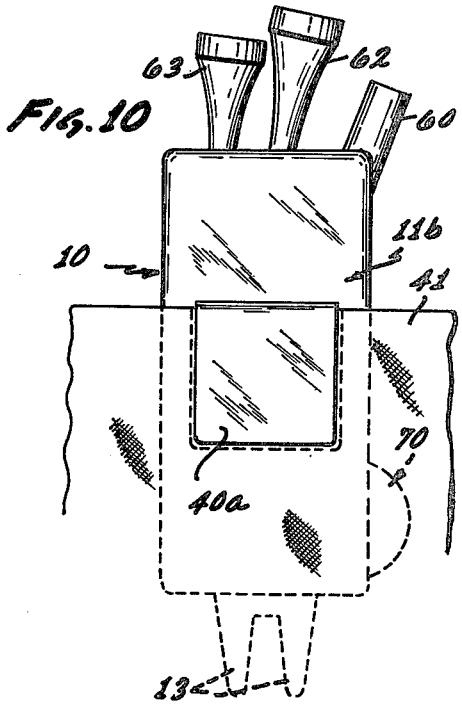
FIG. 10 is a view showing the back of the device with its clip modified to enable it to be held on a pocket.
Figure 15:
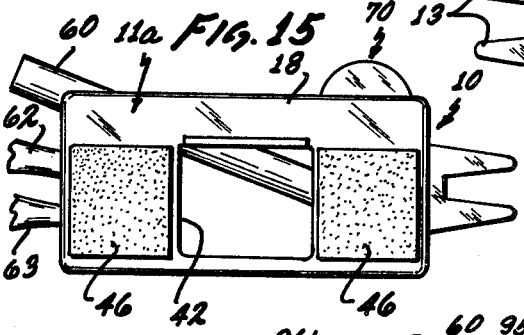
FIG. 15 is a view of the back of the device which has been modified to enable it to be held onto a flat surface.
Figure 13:
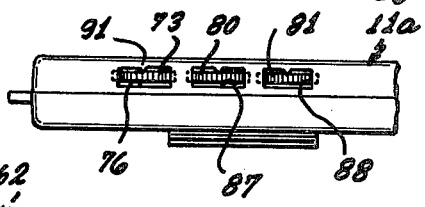
FIG. 13 is a partial view of the device in FIG. 11 as taken along line 13—13.

As shown in FIG. 10, the back portion 11*b* of the device 10 can be alternately formed with an integral clip 40*a* which is molded to extend longitudinally downwardly from the back wall 18 thereof. This enables the device 10 to be held by inserting the clip 40*a* on a pocket 41, for example. It should now be clearly understood that the holding device 10 is small in size so that it can be easily carried on the belt or pocket of a golfer. Furthermore, as shown in FIG. 15, the clip 40 can be severed from the back portion 11*b* and square pieces of tape 46 having an adhering face may be secured to the back wall 18 on either side of the opening 42. These tapes enable the device to be held on a flat surface of a golf cart, for example. Note that with the ball marker 70, the pencil 60 and the tees 62 and 63 mounted in position on the device 10, the latter can be removed from whatever it is held on and held in the hand such that the prongs 13 on the end thereof can be used to repair a ball mark or depression on a green or to clean cleats on the shoes of the golfer.

It should be particularly noted that the holding device 10 is structured such that the openings in which the golfing items are mounted are provided on the edges of the narrow top and end sides thereof thus enabling the face of the front wall 22 thereof to be available for carrying advertising information or other promotional material.

FIGS. 11–14 show the holding device 10 modified to have digit wheels 73, 80 and 81 mounted to project from the lower rim thereof. These digit wheels are used to help keep track of the number of strokes taken by the golfer as the game progresses. Each of the digit wheels 73, 80 and 81 is divided into 10 equal sectors by radial slots 90, each sector bearing one of the digits "0" through "9." The digit wheel 73 is held with its hub 74 mounted to rotate on an opening 75 provided near the bottom of the wall 22 of the front portion 11*a*. A slot 76 is provided on the bottom rim 23 of the front portion 11*a* through which the peripheral edge of the digit wheel 73 extends. The other two digit wheels 80 and 81 are identical to the digit wheel 73 and mounted on the wall 22 of the front portion 11*a* in a similar fashion such that the peripheral edges thereof extend through slots 87 and 88 provided on the bottom rim 23 of the front portion 11*a*. An opening 77 is provided on the front wall 22 of the front portion 11*a* to enable the digit markings on the digit wheel 73 to be viewed therethrough. Likewise, openings 84 and 85 are provided on the front wall 22 of the front portion 11*a* to enable the digit markings on the digit wheels 80 and 81, respectively, to be viewed therethrough.

Figure 14:
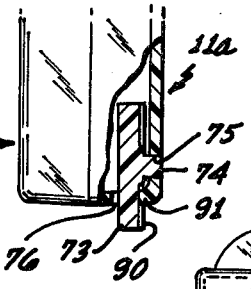
FIG. 14 is a sectional view taken along line 14—14 in FIG. 11.
Figure 11:
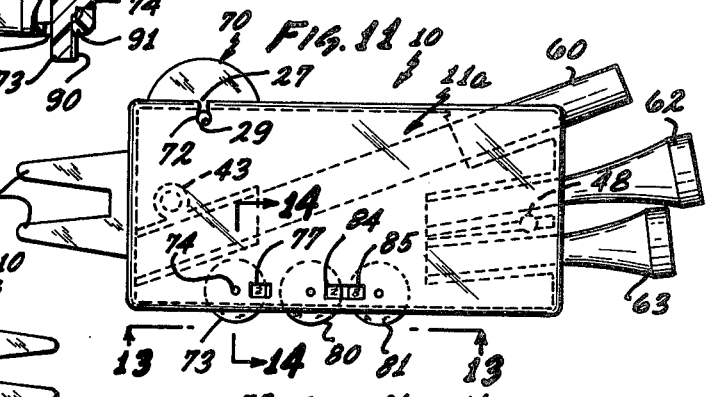
FIG. 11 is a front view of the device in FIG. 1 modified to include digit wheels for keeping score.

As shown in FIG. 14, a knife edge projection 91 may be provided on the side of the slot 76. This projection 91 engages the radial slots 90 as the digit wheel 73 is manually rotated so as to hold it in a particular set position. The slots 87 and 88 in which the other digit wheels 80 and 81 are mounted are similarly formed with knife edge projections 91 to engage the radial slots 90 thereon. The digit wheel 73 is manually rotated from the "0" digit position each time the player uses a stroke on a particular hole to keep track of the strokes per hole. The digit wheels 80 and 81 are manually advanced to accumulate the total strokes for all holes as the game progresses.

Figure 16:
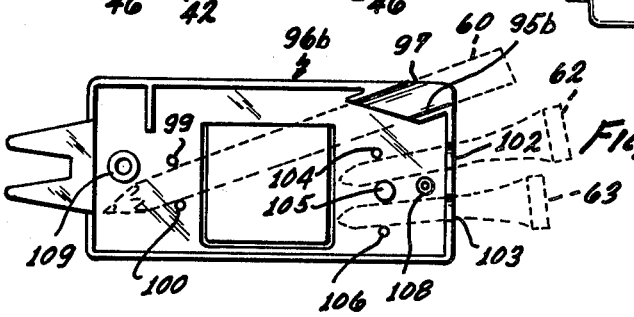
FIG. 16 is a view showing the interior of the back portion of a simplified embodiment of the device.
Figure 17:
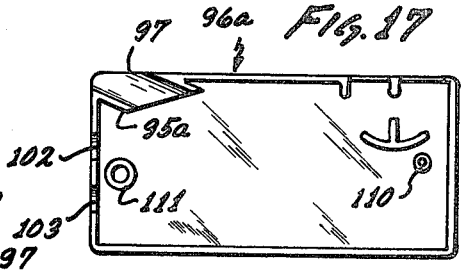
FIG. 17 is a view showing the interior of the front portion of the simplified embodiment of the device.
Figure 18:
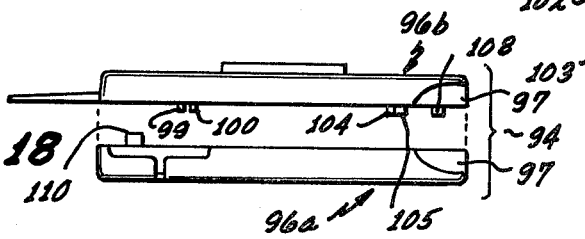
FIG. 18 is an exploded top view of the front back portions of the simplified embodiment of the device shown in FIGS. 16 and 17.

An embodiment of a simplified holding device 94 is shown in FIGS. 16, 17 and 18. Device 94 comprises a mated front portion 96*a* and back portion 96*b* having an upper corner opening 97 for pencil 60 and end openings 102 and 103 for tees 62 and 63. In this embodiment only short semicircularly shaped entrance walls 95*a* and 95*b* are provided on the interiors of the respective front and back portions 96*a L and 96b* for alignment with the corner opening 97 for the pencil 60. Along the path toward the diagonally opposite end of the back portion 96*b* only a pair of pins 99 and 100 are provided. The passageway provided by the short entrance walls 95*a* and 95*b* provide a sufficiently close tolerance for the pencil 60 to suitably guide it in the correct direction within the interior of the holder 94 such that the sharpened end and, therefore, the body of the pencil will be directed and gripped between the pins 99 and 100. In a similar manner the tee openings 102 and 103 only have pins 104 and 105 and 106 aligned along the sides of the paths of their axes on the interior of the back portion 96*b*. Thus, the middle pin 105 together with pins 104 and 106 on either side thereof serve to provide for receiving the pointed ends of the respective tees 62 and 63 for gripping the bodies thereof as they are inserted in the openings 102 and 103. Note that the pins 99, 100, 104, 105 and 106 used for holding ends of the pencil and the tees preferably all extend beyond the rim of the back portion 96*b* to further serve in guiding and holding these items.

As shown in FIG. 16, the interior of the back portion 96*b* is provided with a pin 108 and an opening 109. Likewise, as shown in FIG. 17, the interior of the front portion 96*a* is provided with a pin 110 and an opening 111. As in the embodiment shown in FIG. 3 and 4, the pins 108 and 110 are made to project beyond the rims of the respective front and back portions 96*a* and 96*b* so as to be tightly engaged within the respective openings 109 and 111 when these portions are mated and pressed together.

While the description has been concerned with particular structural embodiments of the present invention, it is to be understood that many other modifications and variations in the construction and arrangement thereof may be provided for without departing from the spirit and scope of the invention or sacrificing any of its advantages and the invention is therefore to be limited only as indicated by the scope of the appended claims.

What is claimed is:

1. A holding device for golf items comprising:

a flat rectangular plastic box having two end walls and elongated top, bottom, front and back walls with a pair of prongs extending from one of said end walls;

said box having an opening in the upper corner thereof opposite the pronged end into which a pencil can be inserted so as to extend diagonally downwardly toward the opposite lower corner thereof, said box including rigid internal wall portions adjacent said upper corner opening and said opposite lower corner thereby forming a passageway aligned with the corner opening for frictionally engaging portions of the length of said pencil;

said box having additional spaced openings on the end wall thereof with the corner opening into which tees can be inserted so as to extend angularly downwardly into the box, said box including rigid internal wall portions adjacent each said additional openings thereby forming passageways for frictionally engaging portions of the shanks of said tees;

said box having on the top wall thereof adjacent the pronged end thereof a longitudinal slot with a central transverse slot extending to the front wall, the end of said transverse slot forming a neck on the upper end of the front wall leading down to a circular opening;

said box having an arcuate wall disposed therein below said longitudinal slot and having transverse ribs disposed therein on either side of said longitudinal slot;

said longitudinal and transverse slots being of a size to permit a ball marker having a flat circular body and a central stem to be inserted therein with said circular body loosely fitted in said longitudinal slot between the transverse ribs, with the end of said stem snapping through the neck of said transverse slot so as to reside in said circular opening and with the bottom edge of said circular body resting on said arcuate wall.

2. The holding device in accordance with claim 1 wherein said box comprises front and back molded plastic portions.

3. The holding device in accordance with claim 2 wherein projecting mating connectors are provided within the front and back portions adjacent either end thereof which connectors when aligned and pressed together serve to assembly said portions to form said box.

4. The holding device in accordance with claim 1 including attachment means on the back of the box.

5. The holding device in accordance with claim 1 wherein said box includes a rigid guide wall joining the internal wall portions adjacent said upper corner opening and said opposite lower corner.

* * * * *